US007399100B1

(12) United States Patent
Plyaskin

(10) Patent No.: US 7,399,100 B1
(45) Date of Patent: Jul. 15, 2008

(54) PISTOL ADAPTATION WITH FLASHLIGHT ATTACHMENT

(76) Inventor: Alexandr Plyaskin, 41 Bennett Ave. #61, New York, NY (US) 10033

( * ) Notice: Subject to any disclaimer, the term of this patent is extended or adjusted under 35 U.S.C. 154(b) by 0 days.

(21) Appl. No.: 11/973,480

(22) Filed: Oct. 9, 2007

(51) Int. Cl.
*F21V 31/00* (2006.01)

(52) U.S. Cl. ..... 362/110; 362/198

(58) Field of Classification Search ..... 362/109, 362/110, 113, 114, 198, 253
See application file for complete search history.

(56) References Cited

U.S. PATENT DOCUMENTS 5,628,555 A 5/1997 Sharrah et al.
6,641,277 B2 11/2003 Smith
6,698,130 B2 * 3/2004 Yang et al. ..... 42/146
7,194,836 B1 3/2007 Urban
7,275,344 B2 * 10/2007 Woodmansee et al. ..... 42/146

* cited by examiner

*Primary Examiner*—Laura Tso
(74) *Attorney, Agent, or Firm*—Aleksandr Smushkovich

(57) ABSTRACT

A combination of pistol and flashlight is provided, comprising a frame including a front portion, a trigger guard, a root positioned adjacently to the front portion and to the trigger guard. The root is treated as follows: removing on both sides of the frame an approximately 2 mm layer of material, defining a number of outer surfaces, and forming two lateral fixation cavities. The combination includes a saddle defining a number of inner surfaces, configured to releasably snug-fit onto the outer surfaces, and two fixation tabs configured to releasably snug-fit into the cavities. The saddle secures the flashlight by suitable fixation means. In embodiments, the flashlight is divided into a lighting portion secured to the saddle and power source portion arranged on the bearer's body. Optionally, the saddle is also placeable on a bearer's finger. The combination has less weight and size, but greater support for the saddle than known constructions.

8 Claims, 8 Drawing Sheets

SECTION A-A

PISTOL ADAPTATION WITH FLASHLIGHT ATTACHMENT

FIELD OF THE INVENTION

The invention relates to firearm attachment means, particularly to flashlight attachments to a pistol, revolver, etc.

BACKGROUND OF THE INVENTION

In the prior art there are known several constructions of flashlight attachments to pistols. For instance, a number of flashlight attachments to pistols and handguns are disclosed in U.S. patents, e.g. U.S. Pat. Nos. 5,628,555; 6,641,277; 7,194,836, etc.

Particularly, U.S. Pat. No. 5,628,555, for example, teaches "a switch actuation apparatus for a firearm-mounted flashlight having a switch mechanism." The aforesaid apparatus includes a flashlight carrier, attached below the pistol's handle. The construction requires substantial modification of the existing pistol handle to adapt it to the apparatus, and causes certain inconvenience when used.

U.S. Pat. No. 6,641,277 teaches: "The tactical light incorporates structure that facilitates a two hand full combat grip on a weapon, such as a pistol or revolver, while using the tactical light." The device is specifically described as follows: "Tactical lights embodying the present invention have a light control switch which can be placed in the off position, in the on position for a constant light beam or in the switch position for intermittent use with a touch-pad switch. When the operator wishes to assume a full combat grip, the support hand is simply brought up to the strong hand and the strong hand knuckles fit into a ridged cantilever handle provided on the tactical light in accordance with the present invention. With the full combat grip, the support hand index finger controls the touch-pad switch which allows the operator to choose whether tactical lights embodying the present invention are on or off." Such a solution necessitates occupying two hands of the weapon bearer, increases the weight and size of the flashlight attachment, and therefore the corresponding size of the holster.

U.S. Pat. No. 7,194,836 teaches a gun attachment that "is rigidly attached to the subframe of the handgun without substantially modifying the same." "The gun attachment adapted to be fitted to a handgun having a vertical, longitudinal and lateral axis, a subframe and a slide. The handgun has a laterally extending member and a trigger guard. The gun attachment comprises a locking system having an extension member, such as a set screw in one form, having a forward surface that is adapted to engage the trigger guard of the handgun, a slotted surface defining an open region adapted to engage the subframe of the handgun, and a forward member extending vertically having a forward engagement surface adapted to have an external force applied thereto and transfer the energy of said force to the subframe of the handgun. The extension member such as a set screw in one form is adapted to move with respect to the base region and forcefully engage the trigger guard to provide a positive movement whereby the slotted surface forcefully engages the subframe and the gun attachment adapted to be rigidly attached to the handgun." The above-described construction increases the width of the pistol and its weight.

The S.W.A.T. magazine (www.swatmag.com) in its December 2003 issue published an article called "Kimber's Interim CQB Pistol" mentioned "A number of lights . . . were tested. The SureFire lights (several models) were head and shoulders above the rest."

American Rifleman (official journal of the National Rifle Association of America) issued in April 2003 in its article "The Go-to Gun" by Daniel T. McElrath in particular says: "Each officer is issued two Kimber pistols, one with and one without a gun-mounted SureFire flashlight. As the lights are not quickly detachable, officers carry the light-enhanced guns when they know that they'll be operating in a low-light environment and the plain pistols supplemented with hand-held lights for general duty. Light is now widely acknowledged as a "force level option" in law enforcement, thanks largely to the powerful units produced by SureFire and the techniques developed by the SureFire Institute." The article contains photographs of the pistol with the flashlight attached thereto by means of rail.

One of the known Kimber's models is the Custom TLE/RL II, which comprises a tactical accessory rail, usable for attachment of a flashlight: "Integral universal tactical rails allow the quick, secure installation of accessories such as lights—an advantage that has been repeatedly proven by the tactical community." The width of supporting surface for the flashlight in this case is about 0.84". Approximately the same width has the supporting surface of similar Glock's pistols. Naturally, such rails lead not only to enlargement of sizes, but inevitably to an essential increase of the pistol's weight. To provide enough power for the flashlight, it encapsulates a required number of batteries, which substantially adds to the total weight that worsens the overall operability of the bearer.

BRIEF DESCRIPTION OF THE INVENTION

An aim of the present invention is to create an improved flashlight fixture, herein called a 'saddle', releasably attachable to a pistol, which saddle is usable for securing a flashlight.

Another aim of the invention is to significantly reduce the weight of the saddle with the flashlight, and thereby to enhance operability of the pistol bearer.

Another aim of the invention is to adapt the existing pistol construction and thereby to create a new base (support surface area) on the pistol's frame for attaching the saddle to the pistol.

Another aim of the invention is to provide "flash-dazzle" and regular illumination modes of the flashlight.

Other aims of the invention might become apparent to those skilled in the art from a consideration of the drawings, ensuing description, and claims as hereinafter related.

A first inventive improvement comprises adaptation of the pistol frame by cutting out its middle region portion adjacent to the trigger guard, which portion is herein called a 'root', and milling out two lateral fixation cavities in the root areas on both sides, so that forming the new base for attaching the saddle, which base including a number of support, fixation, and guiding surfaces described herein below, and used for attachment of the saddle to the pistol frame.

A second inventive improvement comprises creation of the saddle, capable to releasably fit onto the new base and be attached to the pistol when necessary, which saddle has a reduced size and weight, comparatively to known flashlight attachments. Alternatively, the saddle can be placed on the index or another finger of a person, to light up a space in front of him/her.

A third inventive improvement comprises dividing the flashlight into two parts: a lighting part (including optics, lamp, wires, and a first switch) and a source part (typically including a set of batteries and a second switch). The lighting part is secured to the saddle. The source part, representing a major weight and size portion of the flashlight, is placed on a suitable location of the bearer's body and is electrically connected to the lighting part. The first and second switches allow for turning on and off the light from their respective locations depending on the situation of using the light, and independent on each other.

BRIEF DESCRIPTION OF THE DRAWINGS

Identical reference numerals or letters in the drawings generally refer to the same elements in different figures. A first-time introduced numeral or letter in the description is enclosed into parentheses.

DESCRIPTION OF A PREFERRED EMBODIMENT OF THE INVENTION

Figure 1:
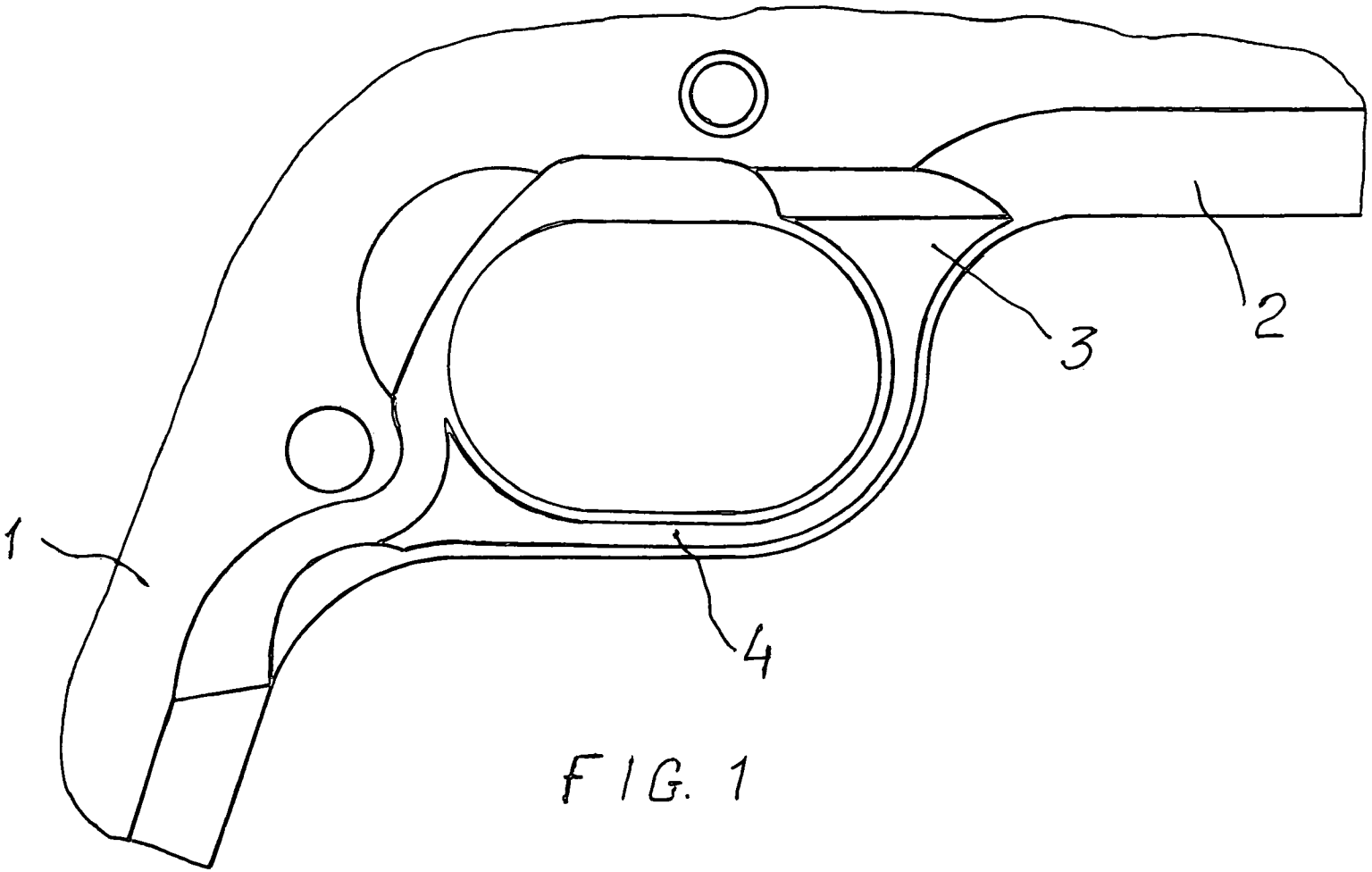
FIG. 1 illustrates a partial side view of an existing pistol construction.

While the invention may be susceptible to embodiment in different forms, there are shown in the drawings, and will be described in detail herein, specific embodiments of the present invention, with the understanding that the present disclosure is to be considered an exemplification of the principles of the invention, and is not intended to limit the invention to that as illustrated and described herein.

As shown on FIG. 1, a typical existing construction of a pistol includes a frame (1), particularly comprising a front portion (2), which is utilized for mounting flashlights in the aforementioned Kimber and Glock's pistols. The rear end of the front portion 2 is joined to a trigger guard (4), and, as defined above, represents a root (3). Typically, the root 3 is approximately 2 mm thicker than the front portion 2 itself. Therefore, cutting or milling out the 2 mm with a predetermined deviation on both sides of the frame should not affect its strength.

On the other hand, the milling out a layer of frame material of 2 mm with a predetermined deviation allows adding a substantial area of surfaces to the existing support base that can serve as additional support and guide for a flashlight fixture, herein referred to as a saddle (5), shown on FIGS. 4*a*, 4*b*, 4*c*, 5, 6. In the other words, the reduction of the frame's weight and size leads to an increase of support for the saddle 5, which is a "win-win" situation.

Figure 2:
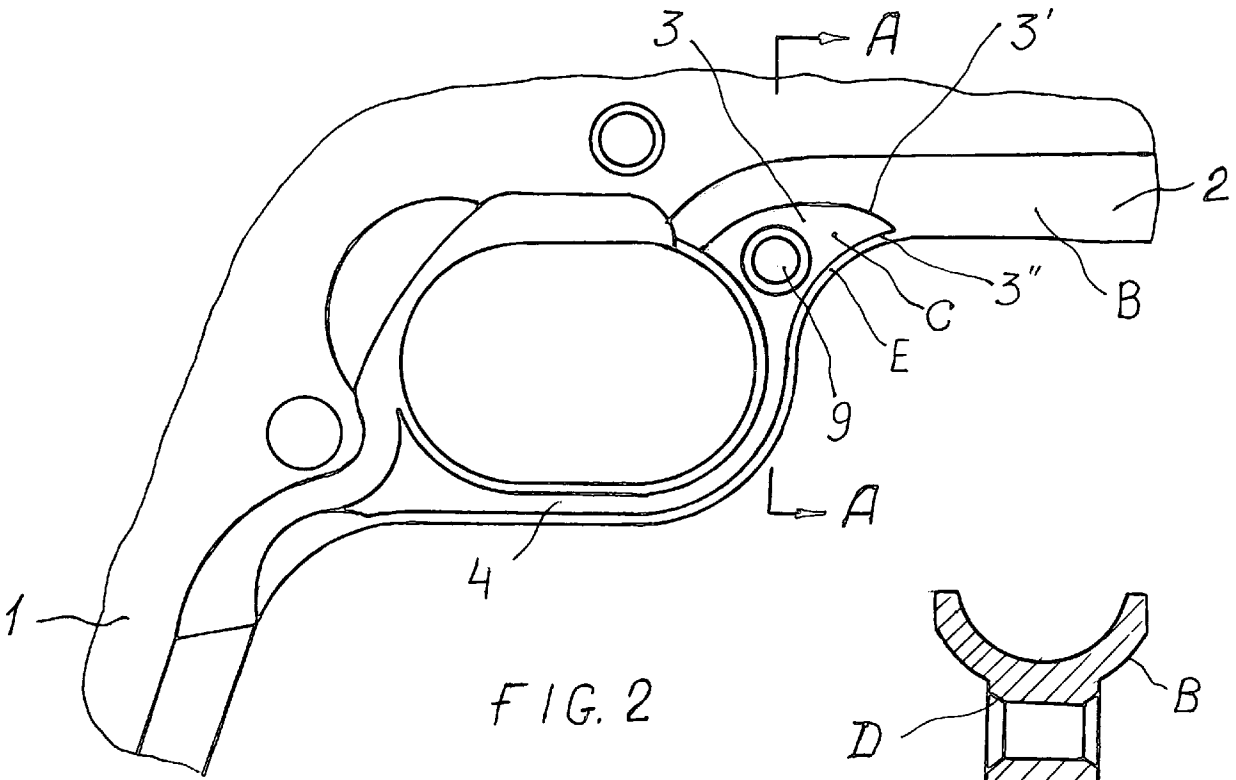
FIG. 2 illustrates a partial side view of an adapted pistol construction, according to the present invention.

FIG. 2 particularly illustrates the root 3 treated according to the invention, i.e. milled out in a first stage of the treatment. A second stage of the treatment is milling out two lateral fixation cavities (9) on both sides of the frame in the root regions. The cavities 9 are preferably made in the form of truncated conical groves. In other embodiments the milling out may be substituted by another known process of removing the layer of frame material and forming the cavities 9.

Figure 3:
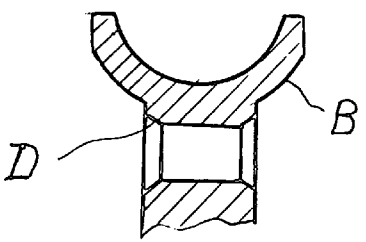
FIG. 3 illustrates a partial sectional side view of the adapted pistol construction, according to the present invention.

As a result of the treatment, predetermined root base outer surfaces are defined on the frame 1 (depicted on FIGS. 2 and 3) as follows: a previously existed curved (substantially having a half-cylinder shape) surface (B) of the front portion 2; a previously existed curved surface (E) of the front of the trigger guard 4; two flat lateral surfaces (C), newly formed after the milling on both sides of the frame in the root region, whose areas are limited by a milled-out line (3'), extending between the surfaces B and C, shown on FIG. 2; another milled-out line (3"), extending between the surfaces C and E, shown on FIG. 2; and two lateral fixation surfaces (D), newly formed after the drilling the cavities 9.

The most essential part of the invention is the saddle 5. As indicated above, the new root base area is significantly increased in comparison with the old base area of pre-existing constructions (e.g. Kimber's rail-guide construction), hence the entire contact support surface of the saddle 5 is larger than that of the prior art flashlight attachments. This allows making the saddle narrower, thin-walled, and light-weighted comparatively to the prior art constructions, which improves tactical characteristics of the pistol. The saddle 5 is supported by all aforementioned base surfaces: B, C, D, and E.

Accordingly, the saddle 5 defines predetermined inner surfaces: (B'), (C'), (D'), and (E'), illustrated on FIGS. 4*a*, 4*b*, and 4*c*. The inner surfaces B', C', D', and E' are configured to snug-fit onto the corresponding outer surfaces B, C, D, and E.

The saddle 5 comprises a pair of circular tabs (6) with the outer truncated conical shape, tapering inside, corresponding to the inner shape of the aforementioned lateral fixation cavities 9. The tabs 6 are so configured, that when being fitted into the cavities 9 tightly and releasably fix the saddle 5 to the root 3.

Figure 4C:
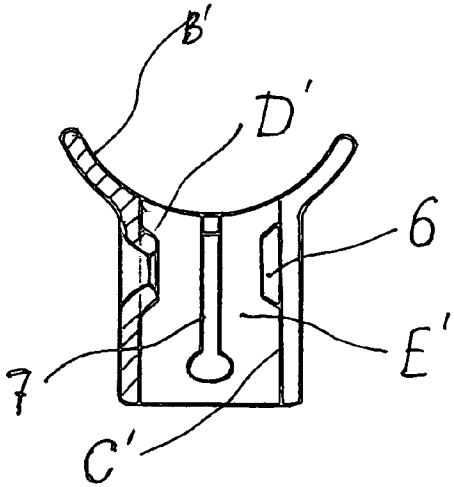
FIG. 4*c* illustrates an orthogonal front view of the adapted pistol construction, according to the present invention.
Figure 4A:
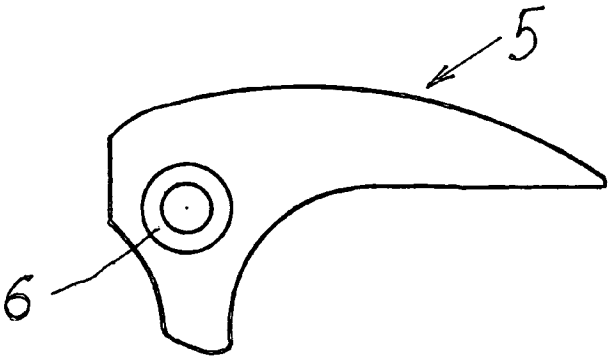
FIG. 4*a* illustrates an orthogonal side view of the adapted pistol construction, according to the present invention.
Figure 4B:
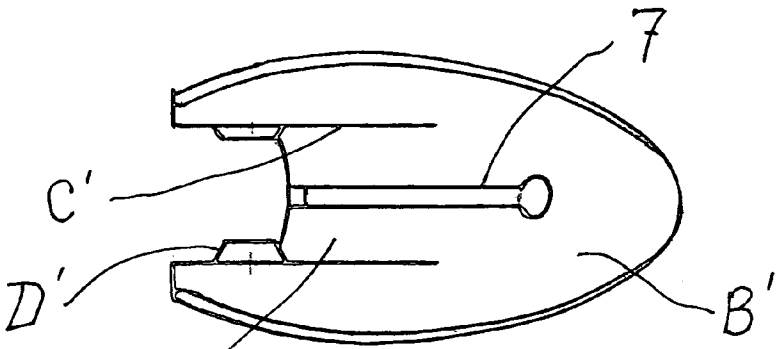
FIG. 4*b* illustrates an orthogonal plan view of the adapted pistol construction, according to the present invention.

In preferred embodiments, the saddle 5 comprises a predeterminedly curved slot (7) made along the central curved line extending through the surface B' and the surface E', as illustrated on FIGS. 4*b* and 4*c*. At each end of the slot 7 there is made an orifice. The saddle 5 should be made of suitable material possessing a predetermined elasticity to tightly and releasably fit onto the base surfaces. Such materials may be represented by springed steel, strong plastics and composites having sufficient elasticity. The slot 7 facilitates the fitting and releasing the saddle 5 from the base surfaces respectively and improves elasticity of the saddle.

In operation, the saddle 5 is snapped onto the root base, whose outer surfaces are snugly fit into the inner surfaces of the saddle. The tabs 6 are tightly engaged with the cavities 9 making the saddle 5 immovable in relation to the frame. In order to remove the saddle 5 from the root base, the operator depresses the lateral sides of the saddle by his fingers thereby disengaging the tabs 6 from the cavities 9, snaps out the saddle by moving it forward from the root 3.

In an optional embodiment a through hole can be drilled through the cavities 9 and tabs 6 of the saddle 5. Such hole may be needed to attach the saddle in an emergency situation, when the saddle became loose and could not be fixed on the root by regular engagement between the tabs and the cavities. For example, a piece of wire can be used to temporary hold the saddle on the root.

Flashlight Modifications

Flashlights mounted on firearms are used in different (including extraordinary) conditions, which set forth high requirements to the power and operation time of electric energy sources feeding the flashlights. This results in significant weight of the flashlight that complicates its usage as an attachment to pistols. Besides, sizable flashlights require additional space in the holsters or on the bearer's belt, creating additional inconvenience.

Figure 5:
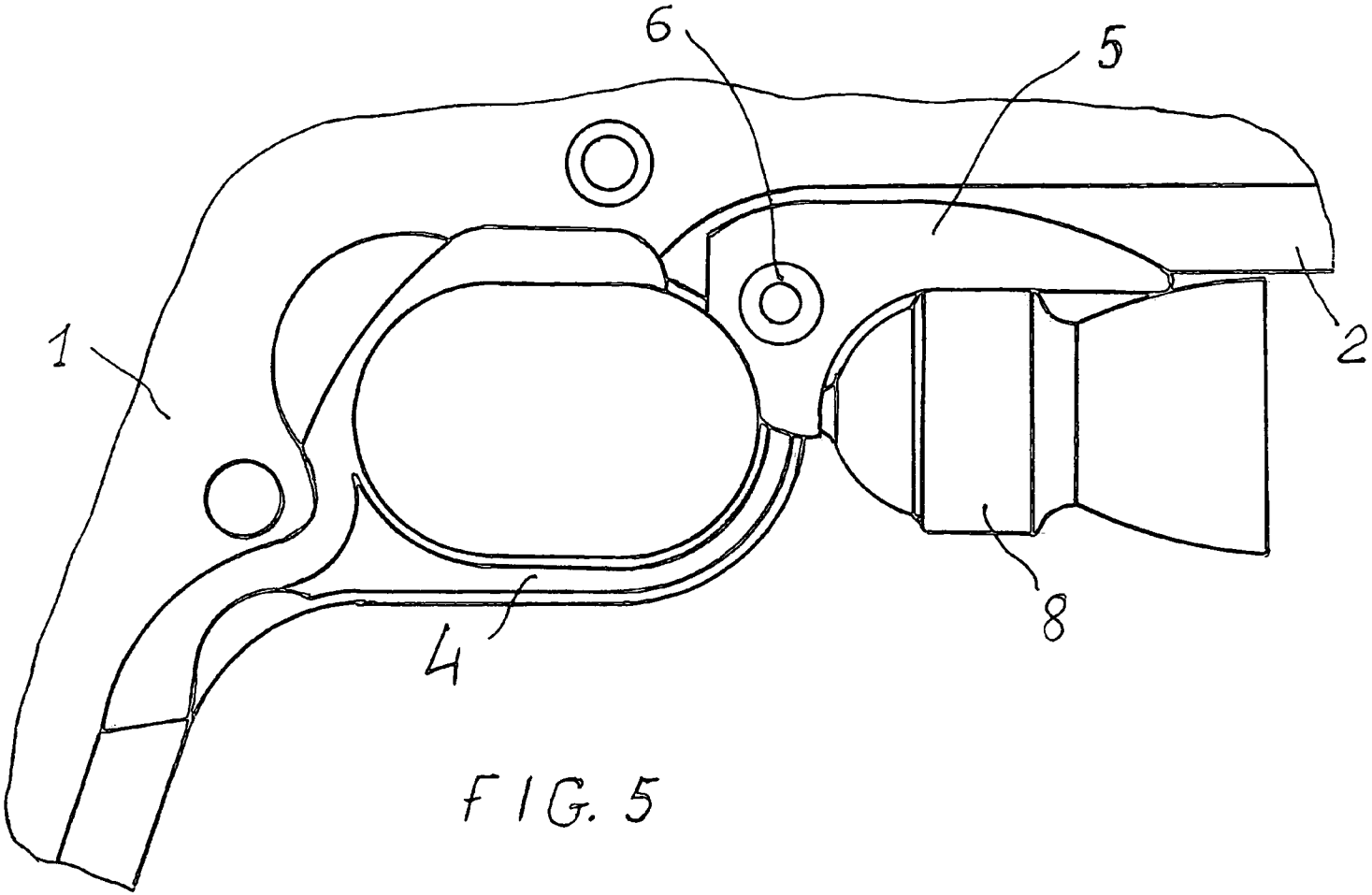
FIG. 5 illustrates a partial side view of an adapted pistol construction with the attached saddle and a flashlight secured on the saddle, according to the present invention.
Figure 7:
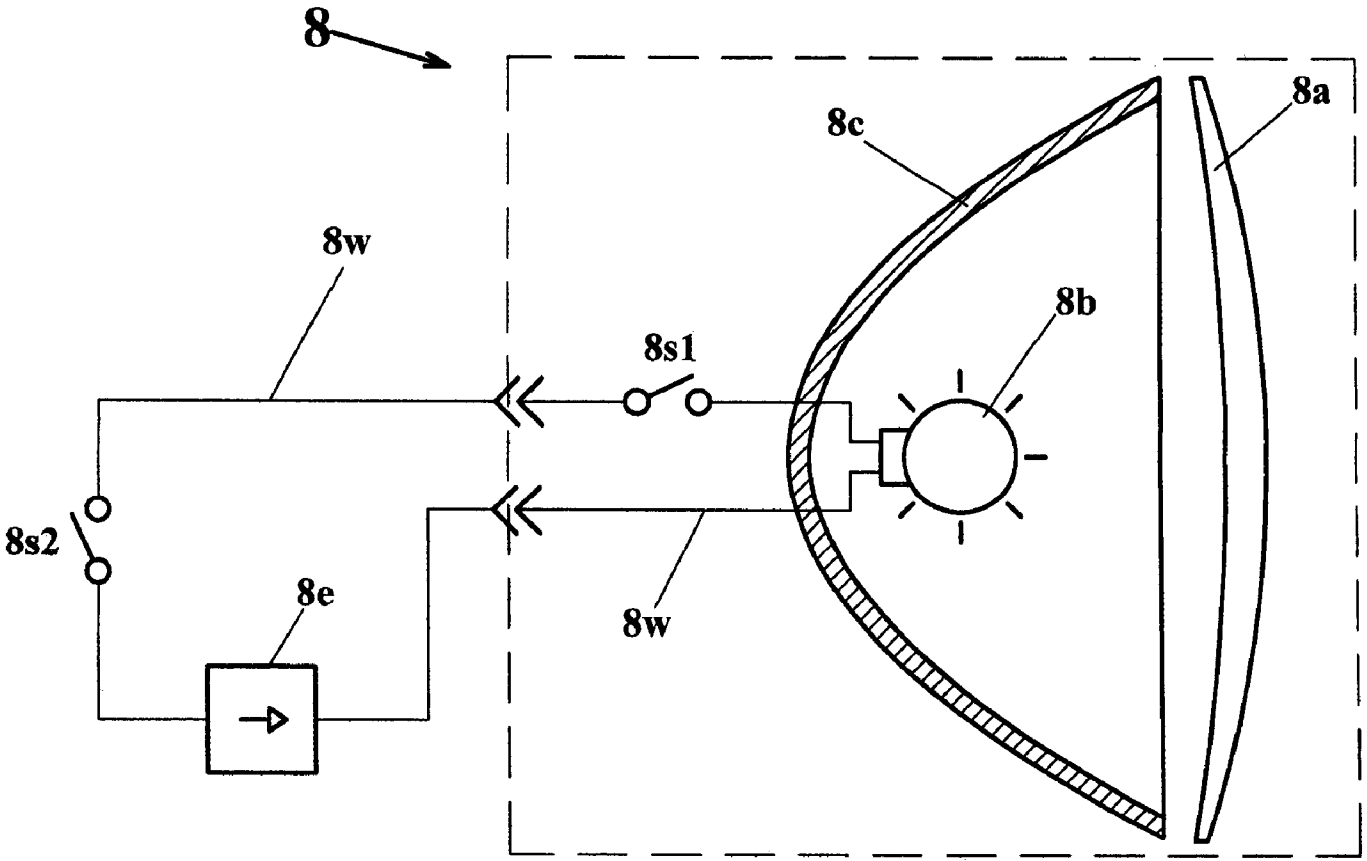
FIG. 7 schematically illustrates a flashlight embodiment with its elements attachable to the saddle.

According to the present invention, the flashlight is divided into two parts: a lighting part (8) illustrated on FIG. 5 and a conventional source part, typically including a set of batteries and a second switch. This embodiment is illustrated in detail on FIG. 7. It depicts conventional optics (8*a*) and (8*c*), a conventional lamp (8*b*), wires (8*w*), a first switch (8*s*1), and a conventional source part including a set of batteries (8*e*) and a second switch (8*s*2).

The lighting part 8 is secured to the saddle 5 (see FIG. 5) by any suitable fixation means (not shown). The fixation means can be standardized for adaptation to different brands of pistols, since they are mostly similar in shape and size. The source part, representing a major weight and size portion of the flashlight, is placed on a suitable location of the bearer's body and is electrically connected to the lighting part. The first and second switches, preferably connected in parallel, allow for turning on and off the light from their respective locations depending on the situation of using the light, and independent on each other.

Figure 8:
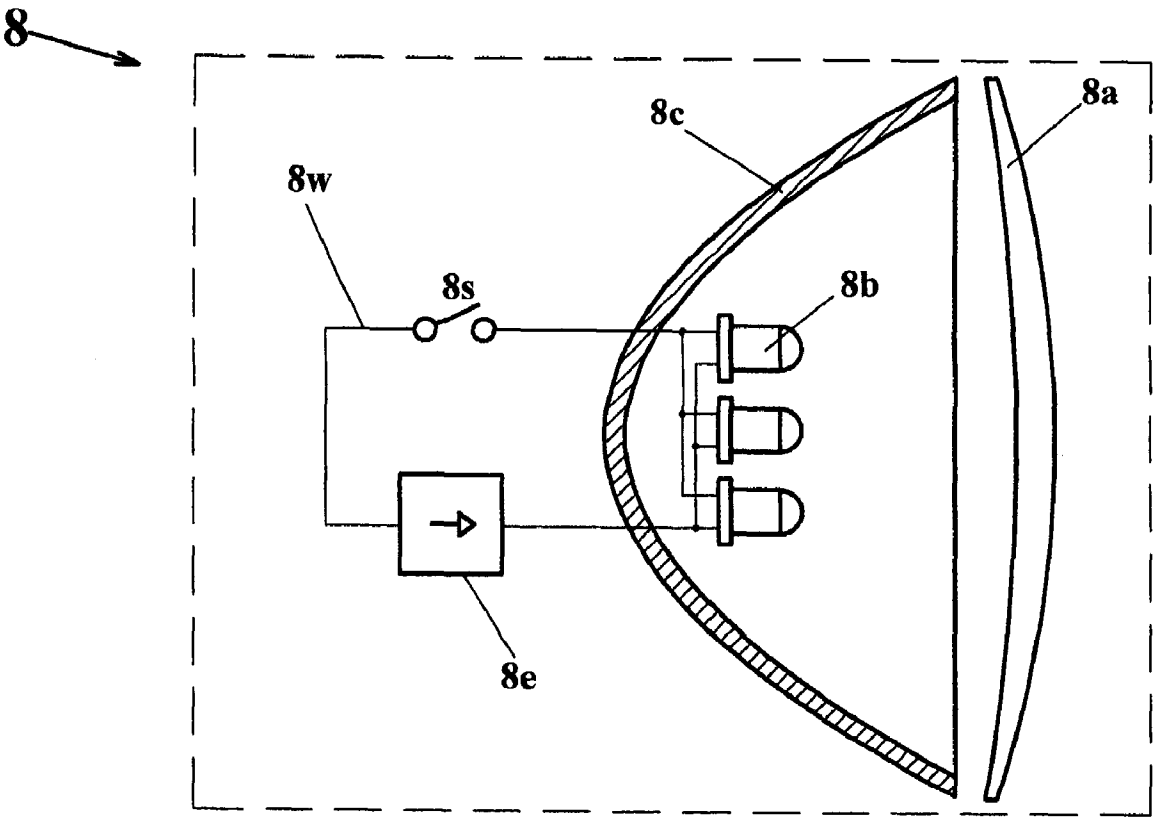
FIG. 8 schematically illustrates another flashlight embodiment with its elements.

In some embodiments, a second supplemental power source can be incorporated into the lighting part 8, especially when LEDs are used, which consume significantly less power. In other heavier embodiments a traditional flashlight (not divided into a lighting and source parts) with batteries is secured to the saddle 5. For some embodiments with LEDs (8*b*) or other low energy consuming devices, a light-weighted source (8*e*) can be incorporated into the lighting part as the primary source (as shown on FIG. 8), so that there would be no need in a separate source part placed on the bearer's body.

A website www.fingerlight.com describes a " . . . Finger Light, worn on Index finger allowing instant-hands free illumination." As shown in accompanying pictures, the Finger Light can be placed on a finger with the help of a ring-shaped attachment. There is no indication or implication of why and how the Finger Light can be attached to a pistol.

According to the present invention, the saddle 5 may be placed not only on the root 3, but also on a finger of the bearer. The size of saddle 5 allows putting it on a finger of an average size. In some cases an intermediate pad can be utilized to suitably place it on the finger. The light-weighted lighting part 8 may be secured to the saddle 5, and the source part may be electrically connected to the lighting part, or just the mentioned supplemental source can be used incorporated into the part 8.

Figure 6:
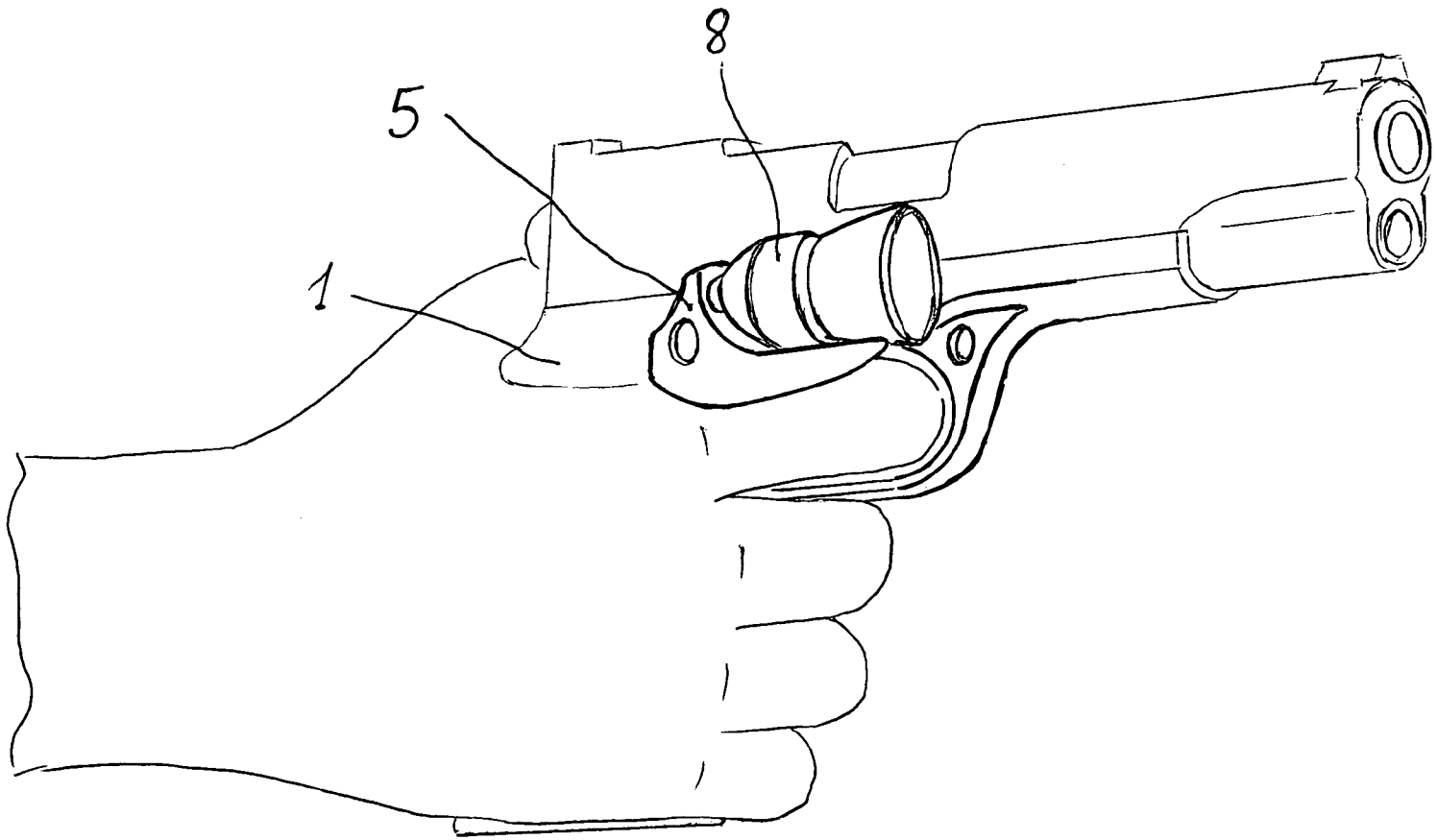
FIG. 6 illustrates a view of the saddle with the flashlight secured on the saddle, wherein the saddle embraces the index finger of a bearer, according to the present invention.

FIG. 6 illustrates a bearer's hand holding a pistol wherein the flashlight 8 is secured on an index finger of the bearer. Alternatively, the flashlight can be placed on the index finger of the other hand of the bearer. The flashlight can be secured on a finger by any suitable attachment means, such as: a bandage, scotch tape, rubber bands, etc.

Figure 9:
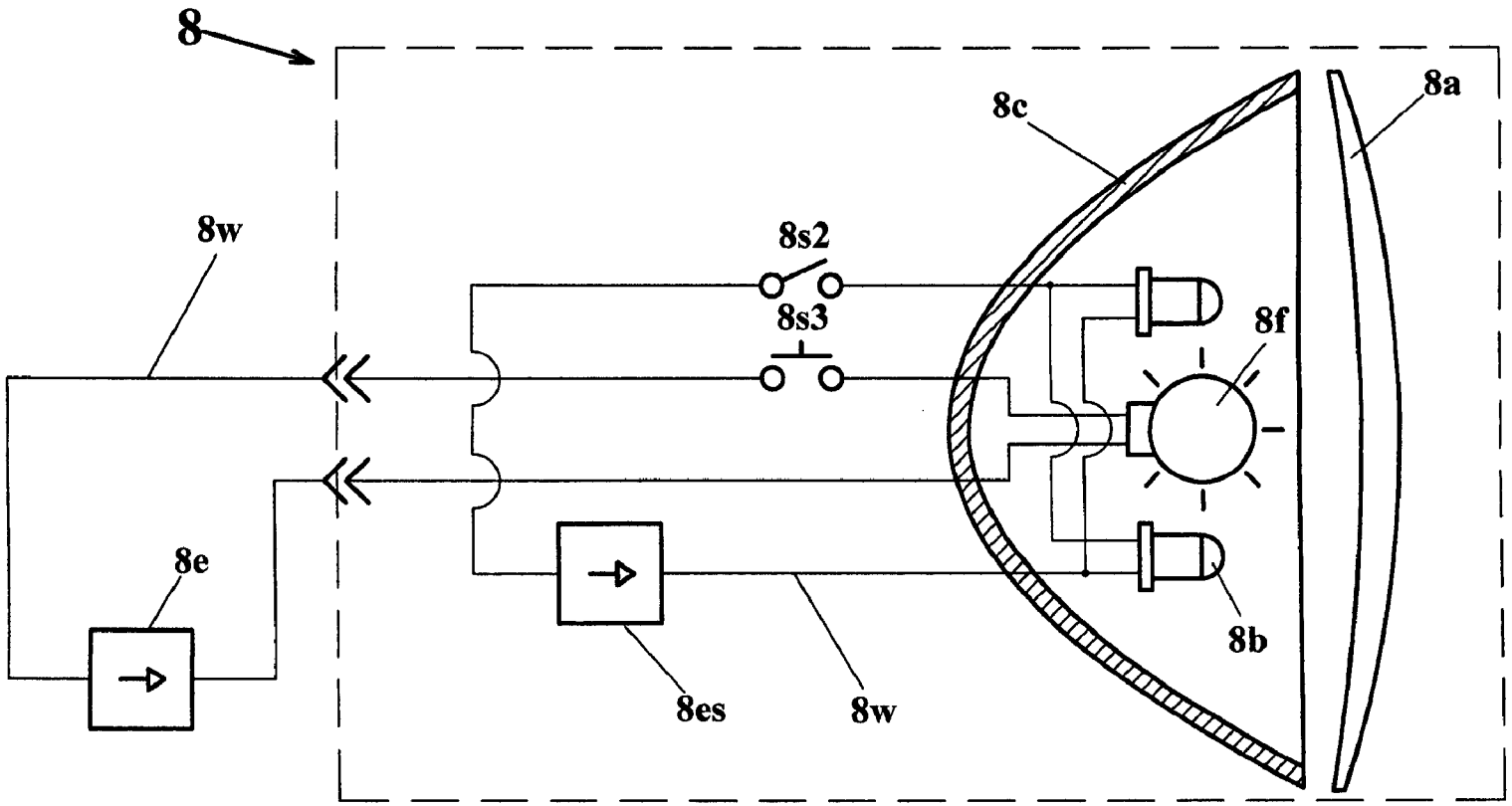
FIG. 9 schematically illustrates another flashlight embodiment with its elements.

In certain emergency circumstances, it is desirable to quickly blind a perpetrator for a few second (this action is herein called a "flash-dazzle" mode), for example, for the bearer to take off the pistol and prepare to the combat position. In such a case, the saddle with the light-weighted flashlight, carried on the finger, might help accomplishing such a task. To provide this, the flashlight should be furnished with a pulse flush lamp (8*f*) suitably incorporated into the flashlight's optics, as shown on FIG. 9. A separate switch (8*s*3) can be used to actuate the pulse flush lamp 8*f* in the "flash-dazzle" mode. Alternatively, the aforementioned first switch can turn on and off the regular lamp and the pulse flush lamp, if the switch is chosen with respective multiple switch positions. The flashlight then can be switched manually or automatically into a regular illumination mode.

COMPARATIVE ANALYSIS OF THE INVENTION & PRIOR ART CONSTRUCTIONS

Approximate parameters of the prior art constructions and of the invention are compared and placed in the appended TABLE, showing the advantages of the invention.

TABLE

| Attachment | Glock's Models | Kimber 2003 | Kimber Rail | Inventive Saddle |
|---|---|---|---|---|
| Frame's Width | 0.840" | 0.761" | 0.840" | 0.362" |
| Frame's Size & Weight | Increased | Increased | Increased | Decreased |
| Flashlight's Size & Weight | Increased | Increased | Increased | Decreased |
| Capable of Carrying on Finger | No | No | No | Yes |
| Holster Size | Special | Special | Special | Regular |

I claim:

1. A combination of a pistol with a flashlight comprising:

a pistol frame including a front portion;

a trigger guard located in the middle portion of the frame;

a root adjacent to the front portion from one end, and to the trigger guard from the other end, said root has been treated as follows:

a. removing a layer of frame material essentially equal to 2 mm with a predetermined deviation on both sides of the frame in the root regions thereby defining a number of predetermined outer surfaces; and b. forming two lateral fixation cavities on both sides of the frame in the root regions;

a saddle defining a number of predetermined inner surfaces configured to releasably snug-fit onto said predetermined outer surfaces, and two lateral fixation tabs configured to releasably snug-fit onto said two lateral fixation cavities; and a flashlight secured to said saddle by any suitable fixation means.

2. The combination according to claim 1, wherein said flashlight essentially comprising a lighting part, substantially including optics, lamp, wires, and a first switch, and a source part, substantially including a set of batteries and a second switch, the first and the second switch connected in parallel to independently turn on and off the lamp;

said lighting part secured to the saddle; and said source part electrically connected to the lighting part, and capable to be placed on a suitable location of the bearer's body.

3. The combination according to claim 2, wherein said saddle so configured that additionally capable to be placed on the index or another finger of a bearer.

4. The combination according to claim 2, wherein said lighting part incorporating a second supplemental power source.

5. The combination according to claim 2, wherein said lighting part including LEDs.

6. The combination according to claim 2, wherein said lighting part incorporating a pulse flush lamp and said first switch capable to actuate the pulse flush lamp in a flash-dazzle mode.

7. The combination according to claim 2, wherein said lighting part incorporating a pulse flush lamp and said combination further including a separate switch capable to actuate the pulse flush lamp in a flash-dazzle mode.

8. The combination according to claim 1, wherein said saddle additionally comprising a predeterminedly curved slot made along the central curved line having a predeterminedly sized orifice at each end, said slot improving elasticity of the saddle.

* * * * *